US005473700A

United States Patent [19]

Fenner, Jr.

[11] Patent Number: 5,473,700

[45] Date of Patent: Dec. 5, 1995

[54] HIGH GAIN ACOUSTIC TRANSDUCER

[76] Inventor: Thomas C. Fenner, Jr., 8081 S. Kendall Blvd., Littleton, Colo. 80123

[21] Appl. No.: 157,913

[22] Filed: Nov. 24, 1993

[51] Int. Cl.[6] ..... H04R 25/00

[52] U.S. Cl. ..... 381/90; 381/88

[58] Field of Search ..... 381/88, 90, 188, 381/205; 181/153

[56] References Cited

U.S. PATENT DOCUMENTS

| | | | |
|---|---|---|---|
| Re. 23,724 | 10/1953 | Seabert . | |
| 2,115,098 | 4/1938 | Engholm | 179/179 |
| 2,778,882 | 1/1957 | Pontzen et al. | 179/115.5 |
| 3,384,719 | 5/1968 | Lanzara | 179/179 |
| 3,524,027 | 8/1970 | Thurston | 175/115.5 |
| 3,567,870 | 3/1971 | Rivera | 179/115.5 |
| 3,720,787 | 3/1973 | Ishii et al. | 381/90 |
| 3,987,258 | 10/1976 | Tsutsui et al. | 179/179 |
| 4,055,170 | 10/1977 | Nohmura | 128/33 |
| 4,105,024 | 8/1978 | Raffel | 128/33 |
| 4,179,009 | 12/1979 | Birkner | 181/171 |
| 4,187,568 | 2/1980 | McMullan et al. | 5/451 |
| 4,399,334 | 8/1983 | Kakiuchi et al. | 179/180 |
| 4,507,800 | 3/1985 | Kelly | 381/88 |
| 4,514,599 | 4/1985 | Yanagishima et al. | 179/181 W |
| 4,550,428 | 10/1985 | Yanagishima et al. | 381/86 |
| 4,635,287 | 1/1987 | Hirano | 381/194 |
| 4,757,548 | 7/1988 | Fenner, Jr. | 381/189 |
| 5,181,253 | 1/1993 | Jordan | 381/188 |
| 5,388,162 | 2/1995 | Sohn | 381/188 |

FOREIGN PATENT DOCUMENTS

| | | |
|---|---|---|
| 2115190 | 10/1972 | Germany . |
| 2745002 | 7/1978 | Germany . |

*Primary Examiner*—Stephen Brinich
*Attorney, Agent, or Firm*—Holland & Hart

[57] ABSTRACT

A high gain acoustic transducer is formed of a voice coil and a magnetic material housed within a transducer housing. The transducer housing includes two symmetrical dome halves formed of a flexible material. Vibrations of the transducer induce a current in the voice coil as the magnetic material is caused to translate relative to the voice coil. Alternatively, electrical signals applied to the voice coil induce vibrations in the transducer. The voice coil is supported by a first of the two dome halves by way of a first support assembly, and the magnetic material is supported by a second of the two dome halves by way of a second support assembly. The first and second support assemblies are positioned against similarly-dimensioned portions of the first and second dome halves, respectively. Resonating surfaces of the two dome halves are of substantially similar dimensions. The housing forms a watertight enclosure, and the transducer may be utilized in underwater applications.

19 Claims, 6 Drawing Sheets

HIGH GAIN ACOUSTIC TRANSDUCER

CROSS REFERENCE TO RELATED PATENTS

The present application is related to U.S. Pat. No. 4,757,548 (1988) to Fenner, Jr., the disclosure of which is specifically incorporated herein by reference.

FIELD OF INVENTION

The present invention relates generally to transducers capable of converting energy between electrical and mechanical form and, more particularly, to a transducer including a housing having flexible, dome-shaped housing portions capable of elastic deformation.

BACKGROUND OF THE INVENTION

Transducers capable of converting energy between mechanical and electrical form have many varied uses. Transducers operative to convert electrical energy into mechanical energy include conventional speakers as well as transducers capable of generating high energy vibrations.

A brief summary of prior art is listed below.

U.S. Pat. No. 4,757,548 (1988) to Fenner, Jr. discloses a speaker system with a dome-shaped enclosure cooperating with the magnet and voice coil to enhance sound waves in an adjacent solid or liquid.

U.S. Pat. No. 3,524,027 (1970) to Thurston et al. discloses a sound enhancement speaker system having a wall mounted speaker. The speaker has a flat base. The magnets are a toroid and a pair of plates. The voice coil is attached to a flat plate which in turn is attached to a screw mounted in the wall.

U.S. Pat. No. 4,399,334 (1983) to Kakiuchi discloses a headphone speaker having a dome shaped diaphragm to amplify the energy of the voice coil.

U.S. Pat. No. 3,567,870 (1971) to Rivera discloses a wall surface sound transducer having a pair of cup-shaped housing members. The active portions of the vibrating surfaces are flat. A flat plate vibrating surface, however, typically exhibits a narrow frequency band response (500–5000 Hz), and exhibits harmonic distortion due to low damping ratios.

U.S. Pat. No. 4,635,287 (1987) to Hirano discloses a vibrating voice coil plate activated by a magnet mounted on a flat plate or a vibrator.

U.S. Pat. No. 4,179,009 (1979) to Birkner discloses a landspeaker mounting assembly for a resonance panel.

U.S. Pat. No. 4,550,428 (1985) to Yanagishima et al. discloses a car speaker in which part of the chassis of a car is used to form a permanent magnetic field.

U.S. Pat. No. 3,987,258 (1976) to Tsutsui et al. discloses a floatable, water proof sound cabinet.

U.S. Pat. No. 4,187,568 (1980) to McMullan et al. discloses an electromagnetic vibrator mounted in a waterbed.

U.S. Pat. No. Re 23,724 (1953) to Seabert discloses an underwater speaker encased in a heavy casing. The diaphragm of the underwater speaker is immersible in water.

U.S. Pat. No. 4,514,599 (1985) to Yanagishima discloses a car speaker mountable upon a car panel in which the car panel is used as a vibrating panel during operation of the car speaker.

U.S. Pat. No. 4,055,170 (1977) to Nohuwra discloses a chair having a vibrating sheet positioned to be in contact with an occupant seated in the chair. A speaker generates mechanical energy which drives the vibrating seat.

U.S. Pat. No. 4,105,024 (1978) to Raffel discloses a pair of vibrator motors mounted inside a furniture frame.

U.S. Pat. No. 2,778,882 (1957) to Pontzen et al. discloses a microphone with a planar diaphragm having both sides exposed to the air which permits enhanced Short range sensitivity.

U.S. Pat. No. 3,384,719 (1968) to Lanzara discloses a set of speakers mounted in a cushioned headrest.

U.S. Pat. No. 2,115,098 (1938) to Engholm discloses a perforated speaker cover which forms a portion of a diaphragm assembly.

Deutsches Pat. No. 2,745,002 (1978) to Nohmura et al discloses a flat plate vibration generator.

Deutsches Pat. No. 2,115,190 (1972) discloses a waterbed having a pump or a speaker which causes generation of pulsed vibrations.

U.S. Pat. No. 3,524,027 to Thurston et al. teaches a flat, plate-type speaker housing. A toroidal magnet and a flat magnet are mounted on the back panel of the speaker housing. The magnets drive a voice coil which is affixed to a flat diaphragm. A spring acts as a damping device for the diaphragm. As the voice coil forces the diaphragm to vibrate, an equal and opposite force causes the magnets and the back panel of the speaker housing to vibrate. All the resultant vibration is transmitted into a bolt fastened in a wall, and the wall resonates with the induced vibrations.

This flat plate type of transducer, however, exhibits only a limited frequency response (500–5000 Hz) and also exhibits harmonic distortion. Harmonic distortions result in the generation of heat energy caused as a result of oscillations of the voice coil in the magnetic field. This heat energy causes heating of the transducer and reduces the life of the transducer.

U.S. Pat. No. 3,567,870 to Rivera teaches a modification to Thurston et al. wherein the speaker housing is modified to include a pair of cup-shaped members. A damping spring required in Thurston is eliminated, and a flatter (more uniform) and wider frequency response is achieved and a reduction of some harmonic distortion is achieved. However, the front and back vibrating speaker housing members are flat. These flat members cause harmonic distortion.

'548 to Fenner, Jr. achieves a higher frequency response (10–30,000 Hz) by using a dome shaped front speaker housing member. Yet, the back speaker housing member remains flat, thereby causing harmonic distortion. Additional harmonic distortion is created by a flat horizontal support member mounted inside the shell shaped speaker housing.

The present invention eliminates all flat speaker housing members. A pair of symmetrical opposing domes comprise the speaker housing. No support member is utilized. Rather, the magnet(s) are mounted directly on the inside of the back dome member. The dome members are rigid, thereby providing a high damping rate without the use of springs. Other design advantages include flatter frequency responses, crush-resistant deep water high pressure housing, crush-resistant load bearing shock absorbing housing useful as shock absorbers, and vibration sensitivity foe active vibration (phase cancellation) applications.

SUMMARY OF THE INVENTION

The present invention advantageously provides a dual domed vibration transducer which exhibits low levels of harmonic distortion and which exhibits a broad band, flat frequency response.

The present invention further advantageously provides a dual dome transducer housing which exhibits a high damping ratio.

The present invention yet further advantageously provides a dual dome transducer housing which forms a water tight enclosure.

The present invention still further advantageously provides a crush-resistant dual dome transducer housing.

Another object of the present invention is to provide the dual dome housing with adequate torsion stability to withstand use in shock absorber applications.

Yet another object of the present invention is to minimize the size requirements of the dual dome housing as compared to a dome/flat housing design.

Other features of the present invention will become apparent upon reading the following description and appended claims, reference being had to the accompanying drawings forming a part of this specification wherein like reference characters designate corresponding parts in the several views.

Before explaining the disclosed embodiment of the present invention in detail, it should be noted that it is to be understood that the invention is not limited in its application to the details of the particular arrangements shown in the figures and described in the specification, since the invention is capable of other embodiments. Also, the terminology used herein is for the purpose of description and not of limitation.

DESCRIPTION OF THE PREFERRED EMBODIMENT

Figures 1, 1A, 1B:
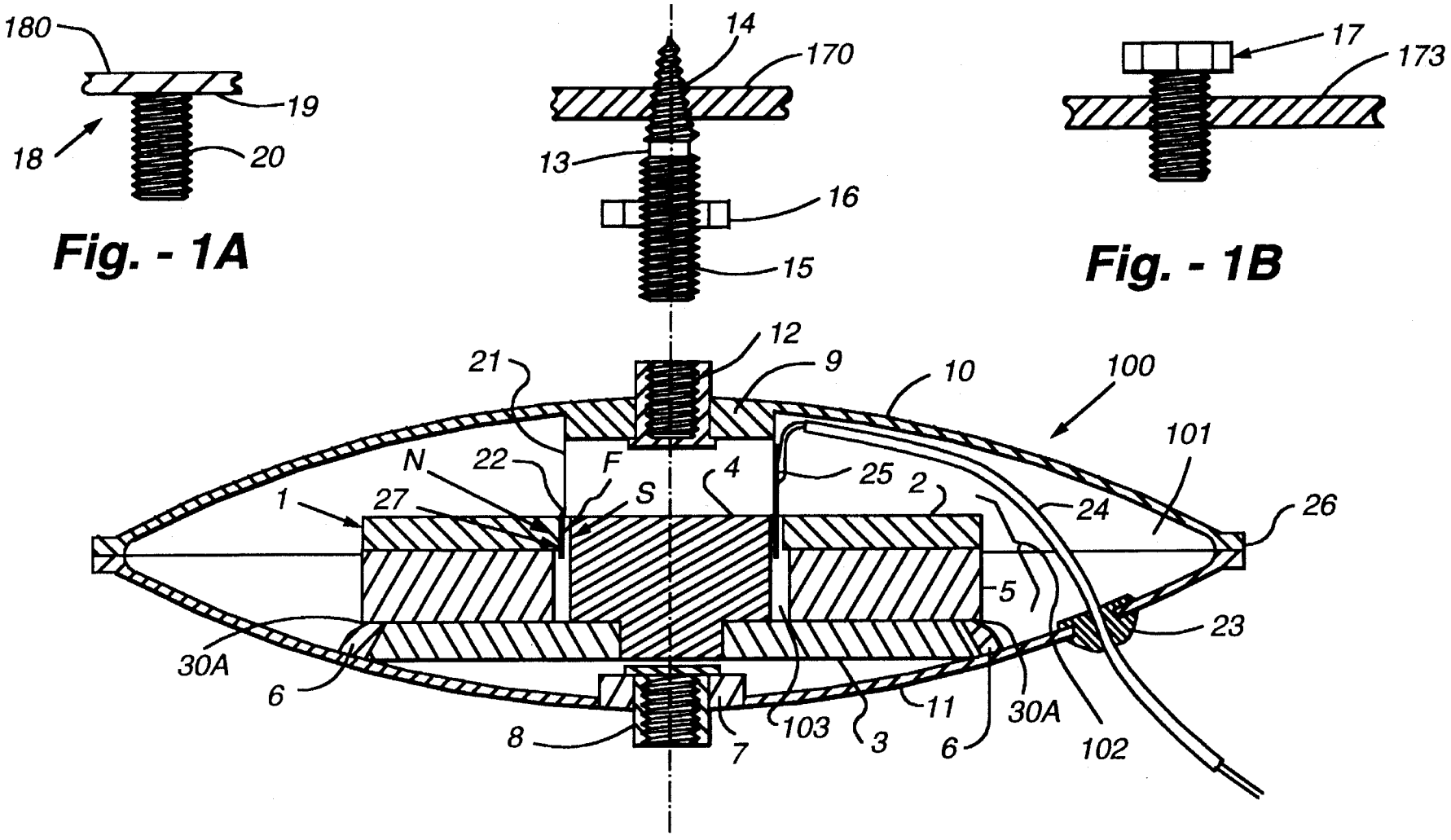
FIG. 1 is a longitudinal sectional view of an embodiment of the transducer of the present invention.

Referring first to FIG. 1 a dual dome transducer 100 of an embodiment of the present invention is shown. The transducer is constructed to permit immersion of the transducer 100 in a liquid. The transducer 100 may be mounted to an external structure such as a bulkhead 170, by any of many various types of fasteners including, for example, a T-weld 18, an anchor bolt 13, or a nut and bolt assembly 17.

The transducer 100 includes a permanent magnet assembly 1. The magnet assembly 1 is preferably formed of rare earth materials. A magnetic ceramic material may alternately be used. In the embodiment shown in FIG. 1, the assembly 1 includes a ferrous top washer 2, a ferrous bottom washer 3, and a center pole piece 4. The center pole piece 4 is attached to the ferrous bottom washer 3 by a compression fit with a ring type magnet 5.

The magnet assembly 1 is held together by an appropriate adhesive. The magnet assembly 1 is centered in a bottom dome half 11 forming a portion of the housing of the transducer 100 and is secured in position with a viscous glue 6. An interference fit is formed between the sloped surface 30 of the bottom washer 3 and the viscous glue 6. A raised boss area 7 in the bottom dome 11 supports a female fastening device 8. The device 8 provides for mounting of the transducer to an external structure such as a motor mount. See FIG. 4. The female fastener 8 is held in place by both compression fit and an appropriate adhesive.

The active side of the dual dome transducer 100 is formed a top dome half 10. A raised boss 9 contains a second female fastener 12 used for fastening to bulkhead 170 as shown.

A core 21 is used as a support means for voice coil 22. The core 21 is held in place on raised boss 9 by an appropriate adhesive. The portion of the core 21 about which the voice coil 22 is supported extends into a slot 103 defined by a gap separating the center pole piece 4 from the washer 2 and ring type magnet 5 of the magnet assembly 1. The core 21 extends into the magnet assembly 1, and the coil 22 is suspended at a mid point 200 of the ferrous washer 2 in close proximity to center pole piece 4.

The top dome half 10 of the housing of the transducer 100 is secured about its circumference 26 to the bottom dome half 11 by an appropriate adhesive. The housing of the transducer 100 forms a sealed structure when a water tight strain relief element 23 is used.

A two conductor wire 24 is then connected to the coil wire leads 25 which then pass through water tight strain relief element 23.

Anchor bolt 13 is utilized for attaching the dual dome transducer 100 to wooden objects. The anchor bolt 13 includes threads 14 to permit threaded engagement with the wooden object. The anchor bolt 13 also includes threads 15 to permit threaded engagement with the fastener 12 supported at the top dome half 10 of the housing of the transducer 100. A lock nut 16 is further utilized, to be tightened down onto female fastener 17 to securely tighten the fitting between the bolt 13 and the transducer 100. Nut and bolt assembly 17 may be used for attachment of the transducer 100 to articles. For instance if the transducer is to be bolted to the bulkhead 170, when bolting through the bulkhead 170 is possible, the nut and bolt assembly 17 may be used. As a means for mounting the transducer 100 to metal or fiberglass bulkheads 180, a male fastener 20 may be glued or welded, shown by weld connection 19, to bulkhead 180, thereby forming T-weld 18. Male fasteners 13, 17, and 18 may be used in conjunction with female fasteners 8 and 12 for mounting of the transducer 100 to any article. Optionally a ferro-fluid F positioned in the slot 103 defined by the elements of the magnet assembly 1, such as Ferro-Fluidics L 11®, is held in place by magnetic poles N,S of the magnet assembly 1. This ferro-fluid F increases the power handling capability of the voice coil 22 by up to three times.

In summary the dual dome transducer 100 comprises a top dome half 10, a bottom dome half 11, an inside space 101 defined therebetween, and a speaker assembly 102 having a core 21 affixed to the upper dome half within the inside space 101. In operation the dome halves expand and contract away and towards one another in response to the energy generated during operation of the speaker assembly 102, or in response to induced vibrations.

Figure 2:
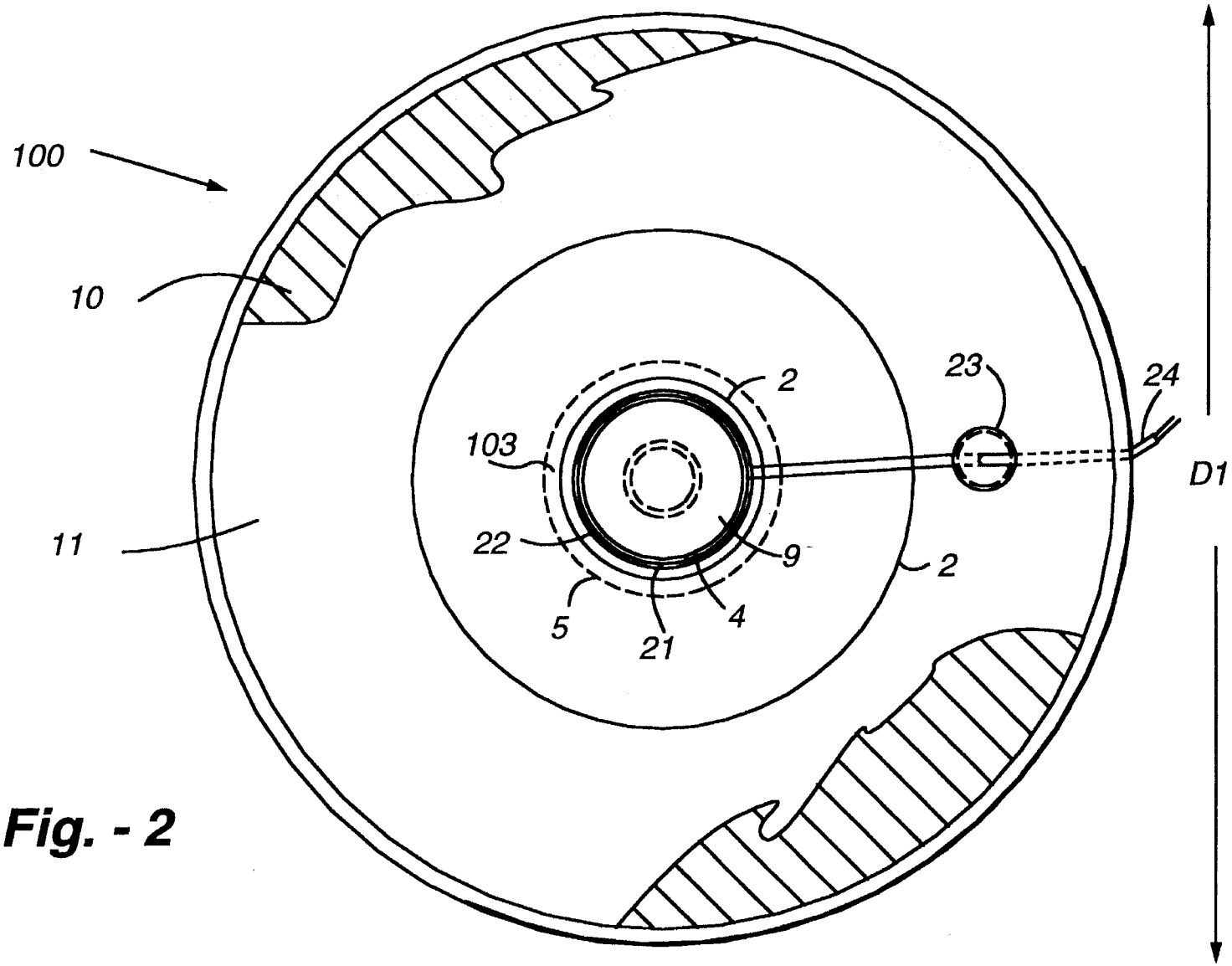
FIG. 2 is a top, partial cutaway view of the transducer of FIG. 1.

Referring next to FIG. 2, the transducer 100 is again shown. The distance d1 spanning opposing sides of the transducer is approximately 8 inches. The performance of the transducer 100 duplicates the performance of the prior art '548 Fenner, Jr. device but is of a diameter six inches smaller than the diameter of '548 Fenner Jr. device which is 14 inches in diameter. Dome halves 10, 11 are preferably made of ⅛ inch Lucite Lt®, or a carbon and graphite composite. Core 21 is preferably made of Kapton©. The ring type magnet 5 is preferably made of Neodymium iron boron having a magnetic gauss oerstad (MGO) of up to 54 MGO.

Figure 3:
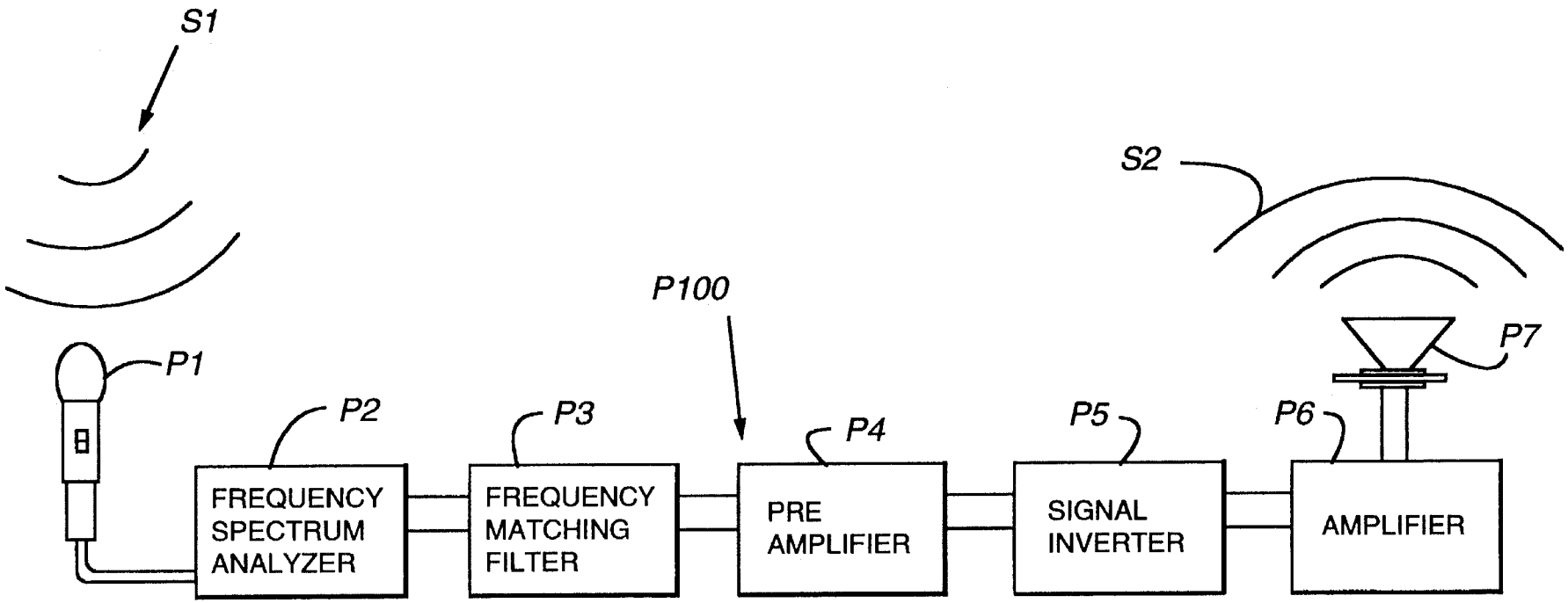
Fig. - 3 (PRIOR ART)
FIG. 3 is a schematic block diagram of a conventional microphone sensing and speaker nullifying active noise reduction system.

Referring next to FIG. 3 is a phase cancellation system P100, known in the art. A microphone P1 picks up sound S1 which needs to be canceled.

A frequency spectrum analyzer P2 is coupled to receive a signal generated by the microphone P1 and is utilized to sort dominant frequencies of the signal applied thereto. The resulting signal is sent to a frequency matching filter P3. The filter P3 matches the inherent frequency response of the microphone P1 to the inherent frequency response of the loud speaker P7. The resulting signal is passed on to pre-amplifier P4 which increases the signal strength of the signal applied thereto. The signal is then inverted by the signal invertor P5 which provides a signal that is 180° out of phase with the input sound S1. The resulting processed signal is then amplified by amplifier P6, and the amplified processed signal is sent to loud speaker P7. The sound S2 generated by the speaker P7 is 180° out of phase with the input sound S1. The overall effect is a reduction of the sound pressure level of resultant sounds S1, S2.

Figure 4:
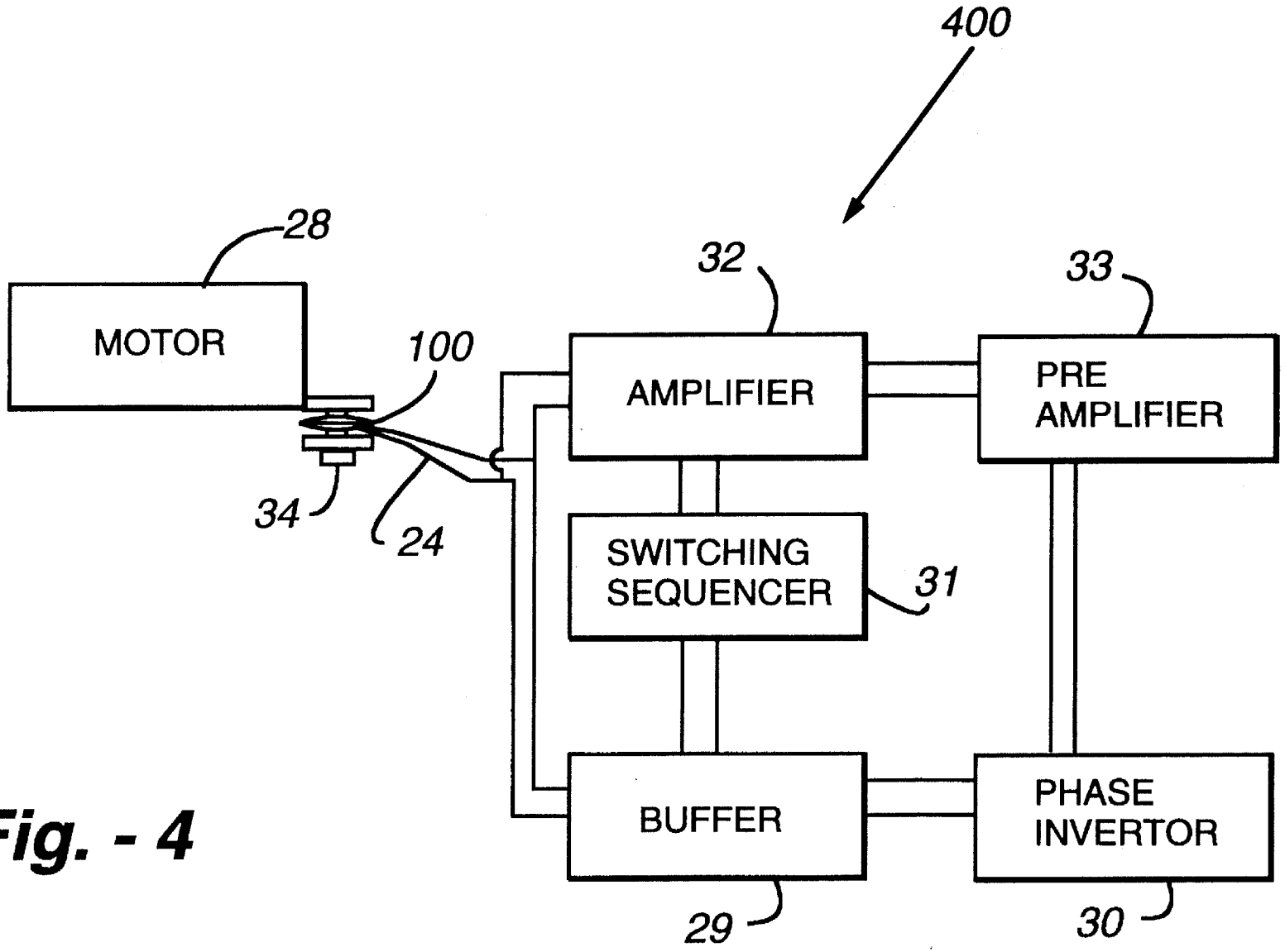
FIG. 4 is a schematic block diagram of an active vibration phase cancellation system of an embodiment of the present invention which includes the transducer shown in FIGS. 1–2 as a portion thereof.

FIG. 4 illustrates a system 400 incorporating the acoustic transducer 100 to provide vibration phase cancellation using a single transducer 100 as a co-spatial instrument capable of sensing and transmitting vibrations. Thus, the transducer 100 is attached in accordance with previous instruction to the vibrating motor 28 and chassis member 34 where it is desired to reduce the vibration. The sequence begins with an electric current being generated in the voice coil 22 by movement produced by the vibrating motor 28. An electrical input signal representative of electric current generated in the voice coil 22 is applied to a buffer 29 on lines 24 and is stored in buffer 29 for a period of approximately 50 micro seconds or less. The signal is then passed on to a phase invertor 30 and then to preamplifier 33. The phase inverted, preamplified signal is then passed to adjustable gain amplifier 32 where the signal is amplified to match the amplitude of the input signal. The amplified inverted signal is then sent back to acoustic transducer 100 where the electrical energy is converted to physical movement that is 180° out of phase with the vibrations generated by the vibrating motor 28. This provides vibration cancellation.

The switching sequencer 31 is utilized to switch the electrical input signal off to buffer 29 when the amplified signal is sent to transducer 100. Conversely the switching sequencer 31 will switch off the amplified signal while the input signal is being received by the buffer 29. The time span for this sequence has been prescribed to be 50 micro seconds or less in that this is the longest duration of sound that is not detectable by the human sense. The acoustic transducer 100 as described by this invention displays inherent mechanical properties that are necessary for this system 400 to function. Those inherent properties include high damping characteristics that preclude the transducer from resonating or continuing to move after the electronic signal is switched off. By using the single transducer as the sending and receiving device the input frequency and amplitude is directly proportional to the output frequency and amplitude. This matching eliminates the need for complex filtering or equalization between components.

Figure 5:
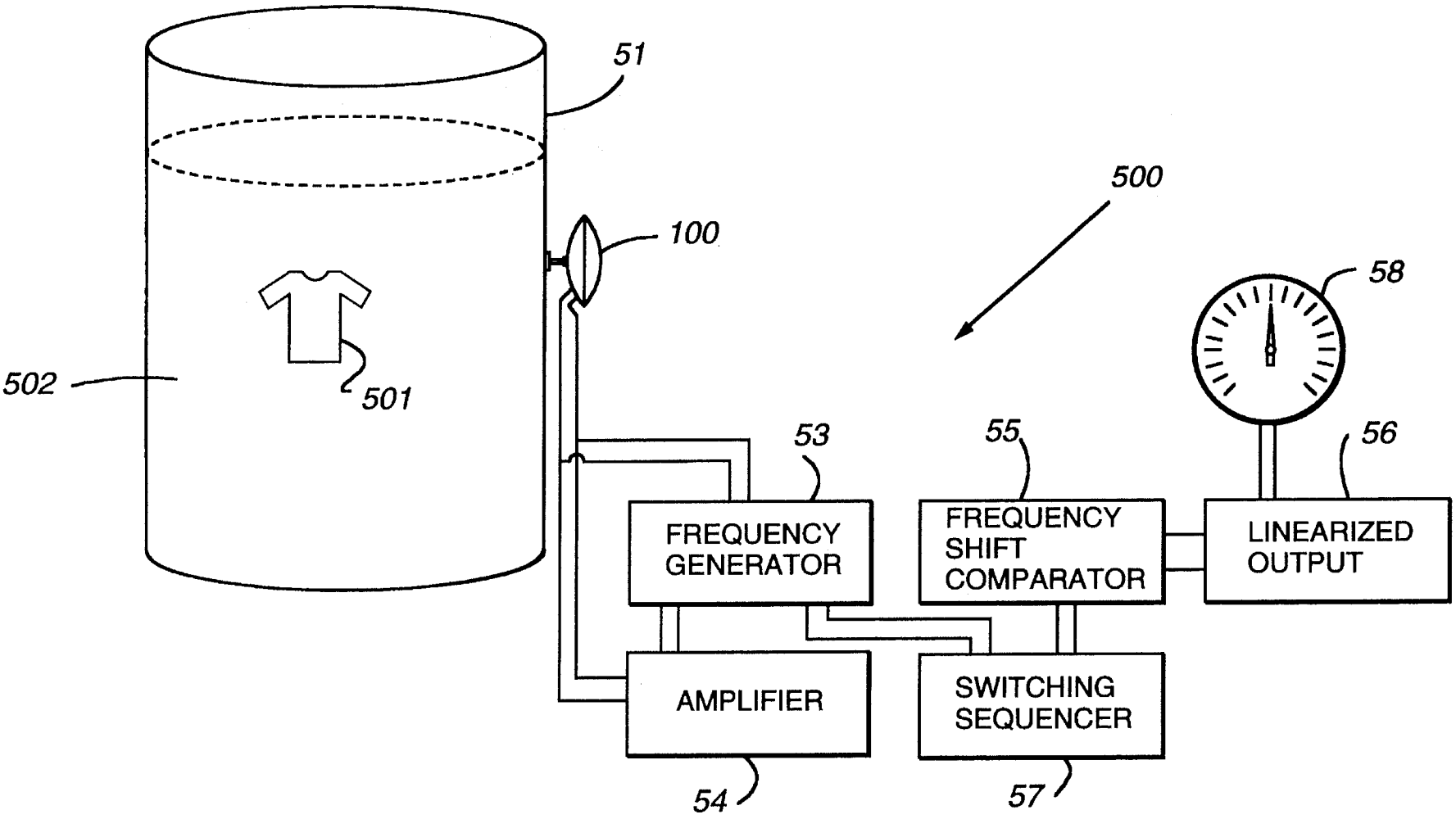
FIG. 5 is a schematic block diagram of an ultrasonic cleaning, vat agitation, and/or non-intrusive level sensing system which includes the transducer shown in FIGS. 1–2 as a portion thereof.

Referring next to FIG. 5 a multi-purpose vat system 500 is shown. Liquid in a tank 51 is energized by vibrations of the transducer 100 mounted upon a sidewall of the tank 51. When the energizing frequency of the vibrations of the transducer 100 (as supplied by a frequency generator 53 and amplified by amplifier 54) is in the ultrasonic range the tank 51 may be used as a container to ultrasonically clean objects 501 inserted into the tank 51. A solvent 502 holds the dirt particles removed during the ultrasonic cleaning process.

A level sensing application is created by varying the frequency of the vibrations generated by the transducer 100 supplied to the tank 51 to determine the natural harmonic resonance of the liquid in the tank. Thereafter, any shift in the resulting output frequency may be interpreted as a change in level of the liquid in the tank. The frequency shift comparator 55 supplies a signal to the linearized output device 56 based on the differential between the determined natural harmonic frequency and the existing frequency which will shift as the level of the liquid in the tank rises or falls. The switching sequencer 57 changes the operating mode from sensing via frequency shift comparator 55 to sending via frequency generator 57. The linearized level signal may then be displayed on a gauge 58.

Another application for the system 500 is to use a high frequency signal as produced by the frequency generator 53 and amplified by amplifier 54. This signal may be used to keep the inside of tank 51 clean.

System components 53–57 may all be incorporated in a solid state chip mounted inside transducer 100.

Figure 6:
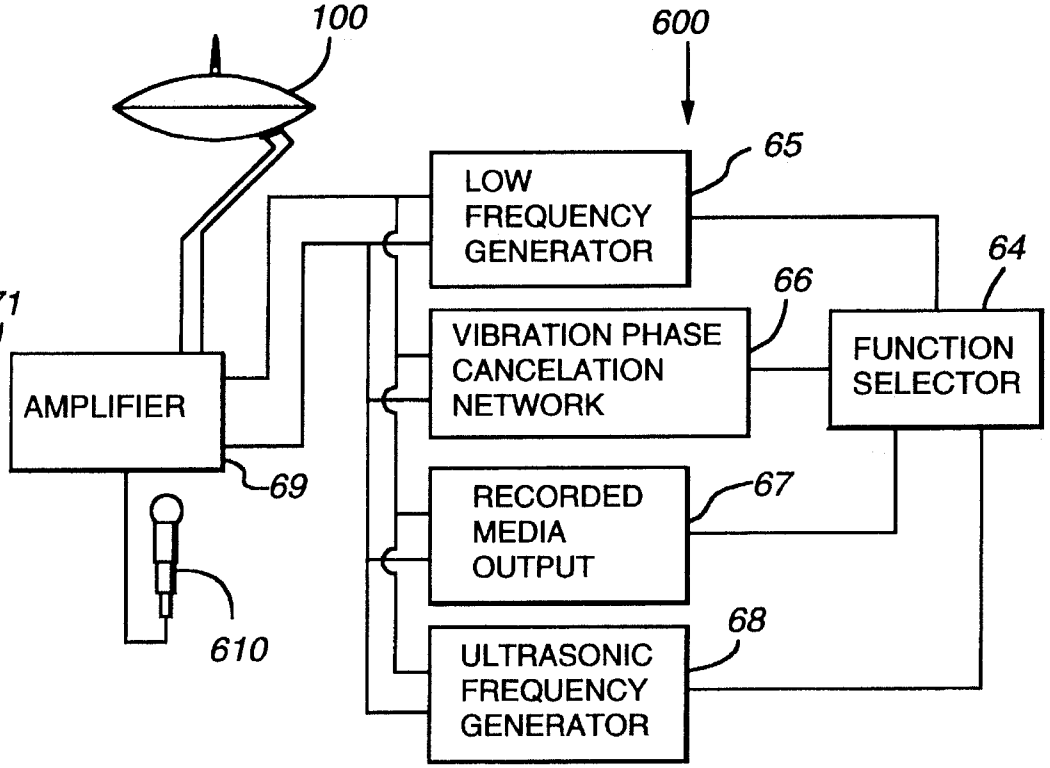
FIG. 6 is a schematic block diagram of a ship-board barnacle prevention, noise cancellation, sound output, and/or hull vibrator system which includes the transducer shown in FIGS. 1–2 as a portion thereof.
Figure 7:
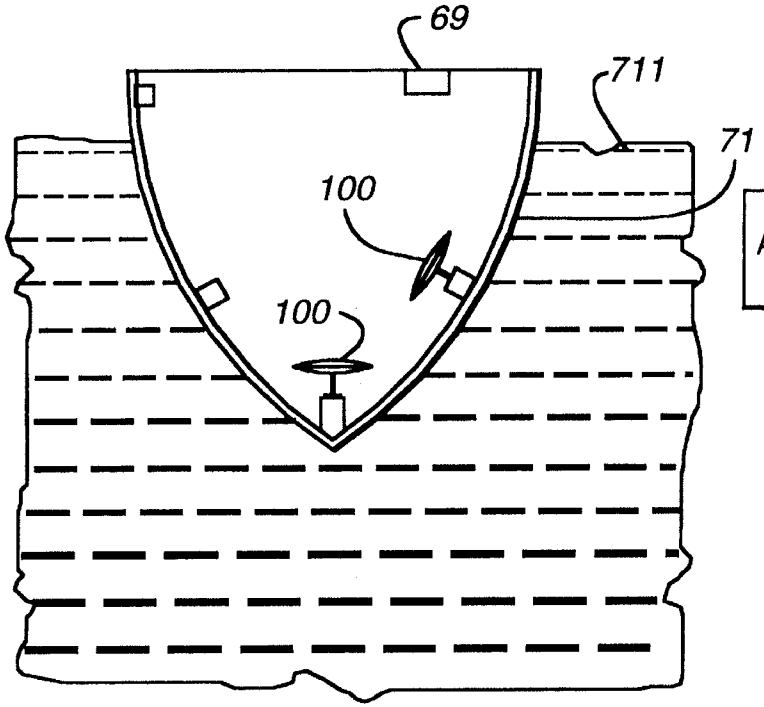
FIG. 7 is a sectional view of a hull showing the placement of a plurality of transducers of the system in FIG. 6.

Referring next to FIGS. 6, 7 a multi-purpose ship-board system 600 is shown. In this system a single high gain acoustic transducer 100 is utilized to provide a multitude of uses. The transducers 100 are rigidly attached to the interior of the hull 71.

The desired hull effect is initiated by the function selector 64. The low frequency generator 65 is utilized to provide a low frequency signal to the amplifier 69. This amplified signal is converted to a physical vibration by the transducer 100. When this low frequency is transmitted through the hull 71, the low frequency physical vibration prevents barnacle formation as is known in the art.

A second application is the vibration phase cancellation network 66, as described previously with respect to FIG. 4. The teaching of FIG. 4 is used to cancel vibrations in the hull 71 that are commonly generated in engineering spaces such as the engine room.

A third application is the recorded media output 67. It is utilized to transmit sound through hull 71 such as the sound image of a school of fish.

A fourth application is the ultrasonic frequency generator 68. It is utilized to create an ultrasonic vibration in the hull 71 which causes a cavitation layer between the hull 71 and the water 711. This cavitation layer reduces the friction coefficient of the hull 71 reducing fuel consumption and increasing speed throughway the water 711.

A fifth application shows the microphone 610 utilized to broadcast verbal messages throughway the hull 71 such as for diver recall.

In all systems the signal is sent to the amplifier 79 and then to the transducers 100. All of the above applications may be used concurrently.

It is known in the art that a configuration of four square magnets could be used to replace the ring type magnet 5. Additionally a cup shaped ferrous metal assembly having a button shaped Neodymium iron boron magnet with a top ferrous metal washer could be used.

I claim:

1. A transducer operable at least to convert electrical energy into mechanical energy, said transducer comprising:

a housing assembly having a first housing portion and a second housing portion, said first housing portion having a first domed section capable of elastic deformation and said second housing portion having a second domed section capable of elastic deformation, the first housing portion and the second housing portion positioned in face-to-face engagement for defining a supportive enclosure therebetween; and a conductive coil positioned within the supportive enclosure defined by said housing assembly, said conductive coil selectively coupled to receive electrical signals and operative to cause elastic deflection of the first and second housing portions, respectively, of said housing assembly responsive to currents in said conductive coil caused by said electrical signals.

2. The transducer of claim 1 further comprising signal processing circuitry coupled to said conductive coil, said signal processing circuitry for generating electrical signals for application to said conductive coil.

3. The transducer of claim 1 further comprising a magnetic material supported within the supportive enclosure of said housing assembly about said conductive coil, said magnetic material translatable responsive to elastic deformation of the first and second domed sections, respectively, of the first and second housing portions.

4. The transducer of claim 3 further operable to convert mechanical energy into electrical energy wherein translation of said magnetic material responsive to elastic deformation of the first and second domed sections induces electrical current in said conductive coil.

5. The transducer of claim 4 further comprising signal processing circuitry coupled to said conductive coil, said signal processing circuitry for receiving the electrical current induced upon said conductive coil, for processing signals representative of the electrical current induced into said conductive coil, and for generating the electrical signals for application to said conductive coil.

6. The transducer of claim 5 wherein said signal processing circuitry comprises a signal delay circuit selectively coupled to receive the electrical current induced upon said conductive coil, the signal delay circuit for generating delayed signals of values representative of levels of the electrical current induced upon said conductive coil, a phase altering circuit for altering phase characteristics of the delayed signals and for generating phase altered signals, and an amplification circuit for amplifying the phase altered signals and for generating amplified signals which form the electrical signals.

7. The transducer of claim 3 wherein said magnetic material comprises a rare-earth material.

8. The transducer of claim 3 wherein said magnetic material comprises a ceramic material.

9. The transducer of claim 3 wherein said magnetic material comprises a toroidal-shaped portion defining a central aperture and wherein said conductive coil is positioned within the central aperture, spaced apart from the toroidal-shaped portion.

10. The transducer of claim 9 wherein said magnetic material further comprises a center core portion positioned within the central aperture defined by the toroidal-shaped portion and spaced apart from said conductive coil.

11. The transducer of claim 10 further comprising a fluid positioned within the central aperture defined by the toroidal-shaped portion.

12. The transducer of claim 9 wherein the toroidal-shaped portion comprises a top, washer-shaped portion, a bottom, washer-shaped portion, and a central ring-shaped portion positioned between the top, washer-shaped portion and the bottom, washer-shaped portion.

13. The transducer of claim 1 wherein the first housing portion is disk-shaped having a first peripheral flange portion and wherein the first domed section is centered about a center of the disk-shaped first housing portion.

14. The transducer of claim 13 wherein the second housing portion is disk-shaped having a second peripheral flange portion, wherein the second domed section is centered about a center of the disk-shaped second housing portion, and wherein the first peripheral flange portion and the second peripheral flange portion abut against one another.

15. The transducer of claim 14 further comprising an adhesive material positioned between the first peripheral flange portion and the second peripheral flange portion, said adhesive material for forming a water-tight seal between the first and second peripheral flange portions, respectively.

16. The transducer of claim 1 further comprising a tubular core member positioned within the supportive enclosure and affixed to the first housing portion to extend therebeneath, wherein said conductive coil is wrapped about said tubular core member.

17. The transducer of claim 1 wherein at least one of the first housing portion and the second housing portion includes a fastener mount for facilitating fastening of the at least one of the first and second housing portions, respectively, to an external object.

18. A transducer operable alternately to convert electrical energy into mechanical energy and to convert mechanical energy into electrical energy, said transducer comprising:

a housing assembly having a first housing portion and a second housing portion, said first housing portion having a first domed section capable of elastic deformation and said second housing portion having a second domed section capable of elastic deformation, the first housing portion and the second housing portion positioned in face-to-face engagement for defining a supportive enclosure therebetween;

a magnetic material supported within the supportive enclosures of said housing assembly, said magnetic material translatable responsive to elastic deformation of the first and second domed sections, respectively, of the first and second housing portions of said housing assembly; and a conductive coil positioned within the supportive enclosure of said housing assembly, said conductive coil selectively coupled to receive electrical signals and operative to cause elastic deflection of the first and second housing portions, respectively, of said housing assembly responsive to currents in said conductive coil, and wherein translation of said magnetic material responsive to elastic deformation of the first and second domed sections induces electrical current in said conductive coil.

19. A housing assembly for a transducer operable at least to convert electrical energy into mechanical energy, said housing assembly comprising:

a first disk-shaped housing portion capable of elastic deformation and having a first raised dome section including a first apical portion, the first raised dome section extending to a first outer peripheral flange member positioned about peripheral sides of the first raised dome section;

a second disk-shaped housing portion positioned in face-to-face engagement with said first disk-shaped housing, said second disk-shaped housing portion capable of elastic deformation and having a second raised dome section including a second apical portion, the second raised dome section extending to a second outer peripheral flange member positioned about peripheral sides of the second raised dome section, the second outer peripheral flange member further positioned to abut against the first outer peripheral flange member; and an adhesive material positioned between the first peripheral flange member and the second peripheral flange member, said adhesive material for forming a watertight seal between the first and second peripheral flange members, respectively.

* * * * *